US011462203B2

(12) United States Patent
Tachi et al.

(10) Patent No.: US 11,462,203 B2
(45) Date of Patent: Oct. 4, 2022

(54) IN-VEHICLE COMMUNICATION SUPPORT SYSTEM

(71) Applicants: ALPS ALPINE CO., LTD., Tokyo (JP); A School Corporation Kansai University, Suita Osaka (JP)

(72) Inventors: Ryosuke Tachi, Iwaki Fukushima (JP); Yoshinobu Kajikawa, Suita Osaka (JP)

(73) Assignees: ALPS ALPINE CO., LTD., Tokyo (JP); A SCHOOL CORPORATION KANSAI UNIVERSITY, Osaka (JP)

( * ) Notice: Subject to any disclaimer, the term of this patent is extended or adjusted under 35 U.S.C. 154(b) by 0 days.

(21) Appl. No.: 17/363,306

(22) Filed: Jun. 30, 2021

(65) Prior Publication Data

US 2022/0005451 A1 Jan. 6, 2022

(30) Foreign Application Priority Data

Jul. 3, 2020 (JP) ..... JP2020-115649

(51) Int. Cl.
*G10K 11/178* (2006.01)

(52) U.S. Cl.
CPC .. *G10K 11/17827* (2018.01); *G10K 11/17823* (2018.01); *G10K 11/17825* (2018.01); (Continued)

(58) Field of Classification Search
CPC ..... H04R 1/406; H04R 2227/001; H04R 2227/009; H04R 2499/13; H04R 5/02; (Continued)

(56) References Cited

U.S. PATENT DOCUMENTS 10,491,998 B1 11/2019 Kominar
2010/0124337 A1 5/2010 Wetz et al.
(Continued)

FOREIGN PATENT DOCUMENTS

EP 2 615 853 A2 7/2013
JP 2002-051392 2/2002
(Continued)

OTHER PUBLICATIONS

European Search Report dated Nov. 25, 2021 in corresponding European Application No. 21181422.3, 9 pages.

*Primary Examiner* — Kile O Blair
(74) *Attorney, Agent, or Firm* — Crowell & Moring, L.L.P.

(57) ABSTRACT

A transfer function of a first variable filter is updated to output, from an output of a first seat microphone, a cancel sound that minimizes a level of a signal obtained by subtracting an output of an auxiliary filter that generates a correction signal for correcting a difference between positions of the first seat microphone and the first seat. In the ICC mode in which the uttered voice of the user in the first seat is output from a second seat speaker, a selector sets an uttered voice Dp output from the second seat speaker as an input to the first variable filter, and in the non-ICC mode, the selector sets an output sound of a second seat audio source output from the second seat speaker as an input to the first variable filter. The uttered voice Dp is generated by removing a component of the cancel sound from the output of the first seat microphone.

7 Claims, 8 Drawing Sheets

(52) U.S. Cl.
CPC .. *G10K 11/17854* (2018.01); *G10K 11/17881* (2018.01); *G10K 11/17885* (2018.01); *G10K 2210/1282* (2013.01); *G10K 2210/3026* (2013.01); *G10K 2210/3027* (2013.01); *G10K 2210/3028* (2013.01); *G10K 2210/3055* (2013.01); *G10K 2210/3221* (2013.01)

(58) Field of Classification Search
CPC ..... G10L 2021/02082; G10L 21/0208; G10L 25/84; H04M 9/082
See application file for complete search history.

(56) References Cited

U.S. PATENT DOCUMENTS

| | | | | |
|---|---|---|---|---|
| 2013/0179163 | A1* | 7/2013 | Herbig | G10L 25/84 381/86 |
| 2013/0179164 | A1* | 7/2013 | Dennis | G10L 21/0216 704/E15.001 |

FOREIGN PATENT DOCUMENTS

| | | |
|---|---|---|
| JP | 2010-163054 | 7/2010 |
| JP | 2020-012917 | 1/2020 |
| WO | 2013/187932 A1 | 12/2013 |

* cited by examiner

IN-VEHICLE COMMUNICATION SUPPORT SYSTEM

RELATED APPLICATIONS

The present application claims priority to Japanese Patent Appln. No. 2020-115649, filed Jul. 3, 2020, the entire disclosure of which is hereby incorporated by reference.

BACKGROUND OF THE DISCLOSURE

1. Field of the Disclosure

The present disclosure relates to a technology for supporting communication by utterance in a vehicle.

2. Description of the Related Art

As a technique for supporting communication based on an utterance in a vehicle, a technique is known in which an uttered voice of a user seated on a first seat of an automobile is collected by a microphone for the first seat and is output from a speaker for a second seat of the automobile (for example, JP 2002-51392 A).

In such a technique, there is also known a technique of canceling sound of music or the like output from a speaker for the first seat from sound collected by a microphone for the first seat and then outputting the sound from a speaker for the second seat (for example, JP 2010-163054 A).

Further, as a technique related to the disclosure, there is known a technology of active noise control (ANC) including: a microphone disposed near a noise cancel position; an adaptive filter configured to generate a cancel sound for canceling noise at the noise cancel position from an output signal of a noise source; and a speaker configured to output the cancel sound, in which in the adaptive filter, a transfer function is adaptively set using a signal obtained by correcting an output of the microphone using an auxiliary filter as an error signal (for example, JP 2020-12917 A and JP 2018-72770 A).

Here, in this technology, a transfer function that corrects a signal actually output by the microphone is set in a signal output from the microphone when the microphone is arranged at the noise cancel position learned in advance in the auxiliary filter, and the noise is canceled at the noise cancel position different from the position of the microphone by using such an auxiliary filter.

In a case where an uttered voice of a user seated on a first seat of an automobile is collected by a microphone for the first seat and output from a speaker for a second seat of the automobile in order to support communication based on an utterance in the vehicle, the uttered voice output from the speaker for the second seat may be collected again by the microphone for the first seat, causing howling, or giving the user seated on the first seat a sense of discomfort that the voice uttered by the user himself/herself is delayed and heard.

Further, in a case where the user of the first seat and the user of the second seat listen to sounds of different sound sources, it is desirable that each user does not listen to a sound of a sound source listened by another user.

Therefore, an object of the disclosure is to suppress, in an environment where a user at each seat of an automobile listens to sounds of different sound sources, the user from hearing the sounds of the sound sources listened by other users, and at the same time, to suppress the uttered voice collected by the microphone for the first seat of the automobile and output from the speaker for the second seat from being collected by the microphone for the first seat.

SUMMARY

To address the above objective, the disclosure provides an in-vehicle communication support system mounted on an automobile having a first seat and a second seat which are different seats from each other. In one form, the in-vehicle communication support system includes: a second seat sound source device that is a sound source device of the second seat; a second seat speaker configured to output an output sound of the second seat sound source device, the second seat speaker being a speaker for a user at the second seat; a microphone configured to collect sound of the first seat; a noise control unit configured to output a cancel sound and an uttered voice signal; a first seat speaker configured to output a cancel sound output by the noise control unit, the first seat speaker being a speaker for a user at the first seat; a selector configured to selectively output, to the noise control unit, one of an output sound of the second seat sound source device and the uttered voice signal output from the noise control unit as a reference sound; and a control unit.

The noise control unit may include: an error signal generation unit configured to generate, using an output of the microphone, an error signal including a component of the reference sound being output from the microphone; a first adaptive filter configured to receive the reference sound as an input and perform an adaptive operation of updating a transfer function so as to reduce a magnitude of the error signal to generate the cancel sound; and an uttered voice signal generation unit configured to generate, as the uttered voice signal, a signal including a component of a voice uttered by the user at the first seat being output from the microphone.

In addition, the in-vehicle communication support system has two operation modes: a first operation mode in which the second seat speaker does not output the uttered voice signal output from the noise control unit; and a second operation mode in which the second seat speaker outputs the uttered voice signal output from the noise control unit. The control unit is configured to cause the selector to output the output sound of the second seat sound source device as the reference sound to the noise control unit in the first operation mode, and to cause the selector to output the uttered voice signal output from the noise control unit as the reference sound to the noise control unit in the second operation mode.

In such an in-vehicle communication support system, it is also preferable that the uttered voice signal generation unit be configured to generate a signal obtained by removing the component of the cancel sound from the output of the microphone as the uttered voice signal.

Further, in this case, the uttered voice signal generation unit may be configured to generate the uttered voice signal by subtracting, from the output of the microphone, a signal obtained by applying a transfer function of a transfer path of the cancel sound to the microphone to the cancel sound.

According to such an in-vehicle communication support system, in the second operation mode, the uttered voice of the user at the first seat is output from the second seat speaker, and communication between the user at the first seat and the user at the second seat by the uttered voice can be supported. In the second operation mode in which the second seat speaker outputs the uttered voice of the user at the first seat while canceling the output sound of the second seat sound source device output from the second seat speaker to the first seat user in the first operation mode in which the second seat speaker does not output the utterance sound of the first seat user, the same noise control unit can be used to cancel the uttered voice of the user at the first seat output from the second seat speaker to the first seat.

Here, in implementations of the in-vehicle communication support system described above, the noise control unit may include an auxiliary filter that is configured to receive the reference sound as an input, and the error signal generation unit may be configured to generate, as the error signal, a signal obtained by subtracting at least the output of the auxiliary filter from the output of the microphone. However, a transfer function obtained in advance as a transfer function for correcting the sound collected by the microphone to the sound collected at the listening position of the sound of the user at the first seat is set to the auxiliary filter by subtracting the output of the auxiliary filter from the output of the microphone.

The above in-vehicle communication support system may include a first seat sound source device that is a sound source device for the first seat that outputs an output sound from the first seat speaker, and the noise control unit may include a second adaptive filter that receives the output sound of the first sound source device, performs an adaptive operation of updating a transfer function so as to reduce the magnitude of the error signal, and outputs a first seat sound source cancel sound, and the error signal generation unit may be configured to generate, as the error signal, a signal obtained by subtracting at least the first seat sound source cancel sound from the output of the microphone.

In this way, the component of the output sound of the first sound source device output from the first seat speaker can be removed from the error signal used by the first adaptive filter for the adaptive operation, so that the first variable filter can be expected to generate a cancel sound that more appropriately cancels the output of the second seat speaker to the first seat.

In addition, in implementations of the in-vehicle communication support system, the noise control unit may include: a fixed filter configured to receive an output sound of the second seat sound source device as an input and output a second seat sound source cancel sound; and an adding unit configured to add the second seat sound source cancel sound to the cancel sound and output the cancel sound from the first seat speaker. The control unit may be configured to cause the adding unit not to add the second seat sound source cancel sound to the cancel sound in the first operation mode, and to cause the adding unit to add the second seat sound source cancel sound to the cancel sound in the second operation mode.

In this case, in the in-vehicle communication support system, when the operation mode is switched from the first operation mode to the second operation mode, the control unit is configured to set a transfer function of the first adaptive filter before the switching as a transfer function of the fixed filter in the fixed filter.

Accordingly, even in the second operation mode, the output sound of the second seat sound source device output from the second seat speaker can be canceled for the first seat.

As described above, according to the disclosure, in an environment where a user at each seat of an automobile listens to sounds of different sound sources, it is possible to prevent the user from hearing the sounds of the sound sources listened by other users, and at the same time, to suppress the uttered voice collected by the microphone for the first seat of the automobile and output from the speaker for the second seat from being collected by the microphone for the first seat.

DESCRIPTION OF THE DRAWINGS

Figure 1:
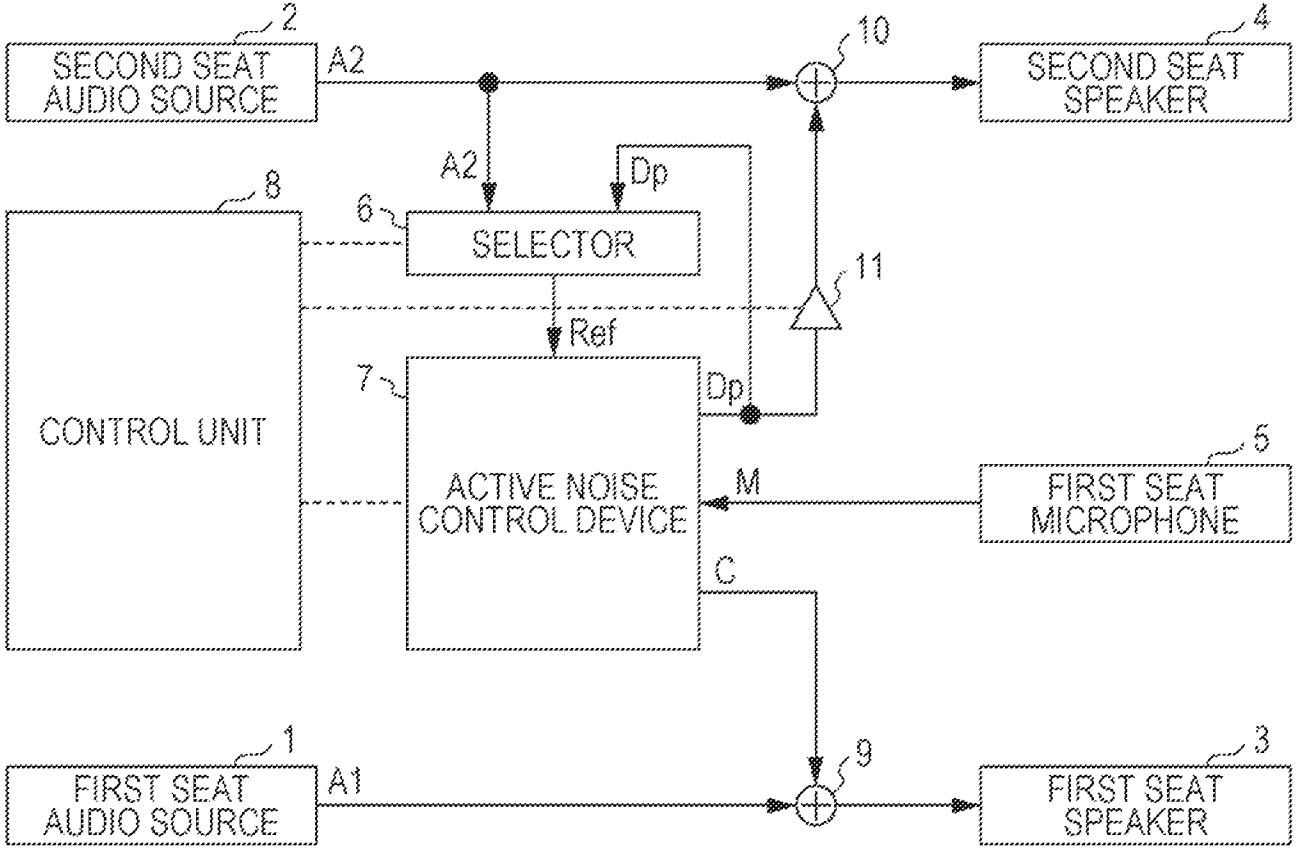
FIG. 1 is a block diagram illustrating a configuration of an in-vehicle communication support system according to a first embodiment of the disclosure.

FIG. 1 illustrates a configuration of one form of an in-vehicle communication support system.

The in-vehicle communication support system is a system mounted on an automobile, and includes a first seat audio source 1, a second seat audio source 2, a first seat speaker 3, a second seat speaker 4, a first seat microphone 5, a selector 6, an active noise control device 7, a control unit 8, a first seat speaker adder 9, a second seat speaker adder 10, and an uttered voice relay unit 11 as illustrated in the drawing.

Figure 2:
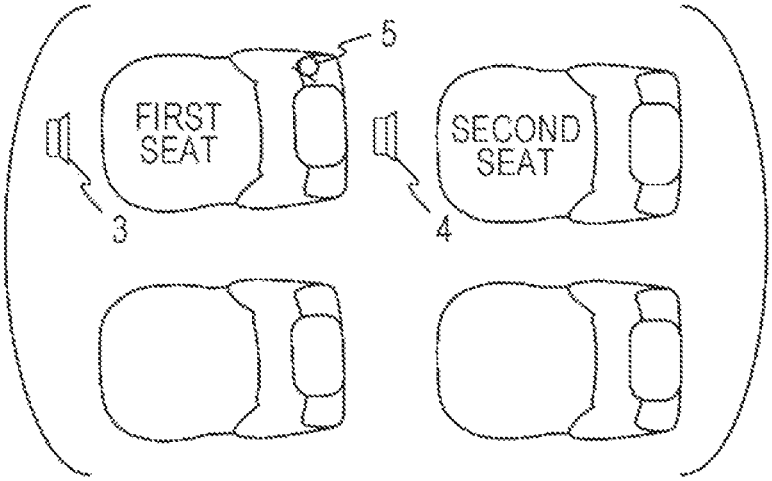
FIG. 2 is a diagram illustrating an arrangement of a speaker and a first seat microphone of the in-vehicle communication support system according to the first embodiment of the disclosure.

As illustrated in FIG. 2, assuming that one seat of the automobile is a first seat and another seat other than the first seat is a second seat, the first seat speaker 3 is a speaker disposed near the first seat for a user at the first seat, and the second seat speaker 4 is a speaker disposed near the second seat for a user at the second seat. The disposition of FIG. 2 is an example, and any disposition and number of the first seat speakers 6 and the second seat speakers 5 may be used as long as the first seat speaker 6 mainly radiates sound to the user at the first seat and the second seat speaker 5 mainly radiates sound to the user at the second seat.

The first seat microphone 5 is a microphone disposed near the first seat as illustrated in FIG. 2, for example.

Returning to FIG. 1, the first seat audio source 1 is a sound source that outputs sound of music or the like listened to by the user at the first seat, and an output sound A1 of the first seat audio source 1 is output from the first seat speaker 3 via the first seat speaker adder 9.

The second seat audio source 2 is a sound source that outputs sound of music or the like listened by the user at the second seat, and an output sound A2 of the second seat audio source 2 is output from the second seat speaker 4 via the second seat speaker adder 10.

The selector 6 selectively outputs one of an uttered voice signal Dp output from the active noise control device 7 and the output sound A2 from the second seat audio source 2 to the active noise control device 7 as a reference sound Ref.

The active noise control device 7 generates the uttered voice signal Dp and a cancel sound C from the reference sound Ref output from the selector 6, the output sound A2 from the second seat audio source 2, and a sound M collected by the first seat microphone 5, and outputs the uttered voice signal Dp and the cancel sound C. Then, the uttered voice signal Dp output from the active noise control device 7 is output to the selector 6, and also output from the second seat speaker 4 via the uttered voice relay unit 11 and the second seat speaker adder 10. The cancel sound C output from the active noise control device 7 is output from the first seat speaker 3 via the first seat speaker adder 9.

Figure 3:
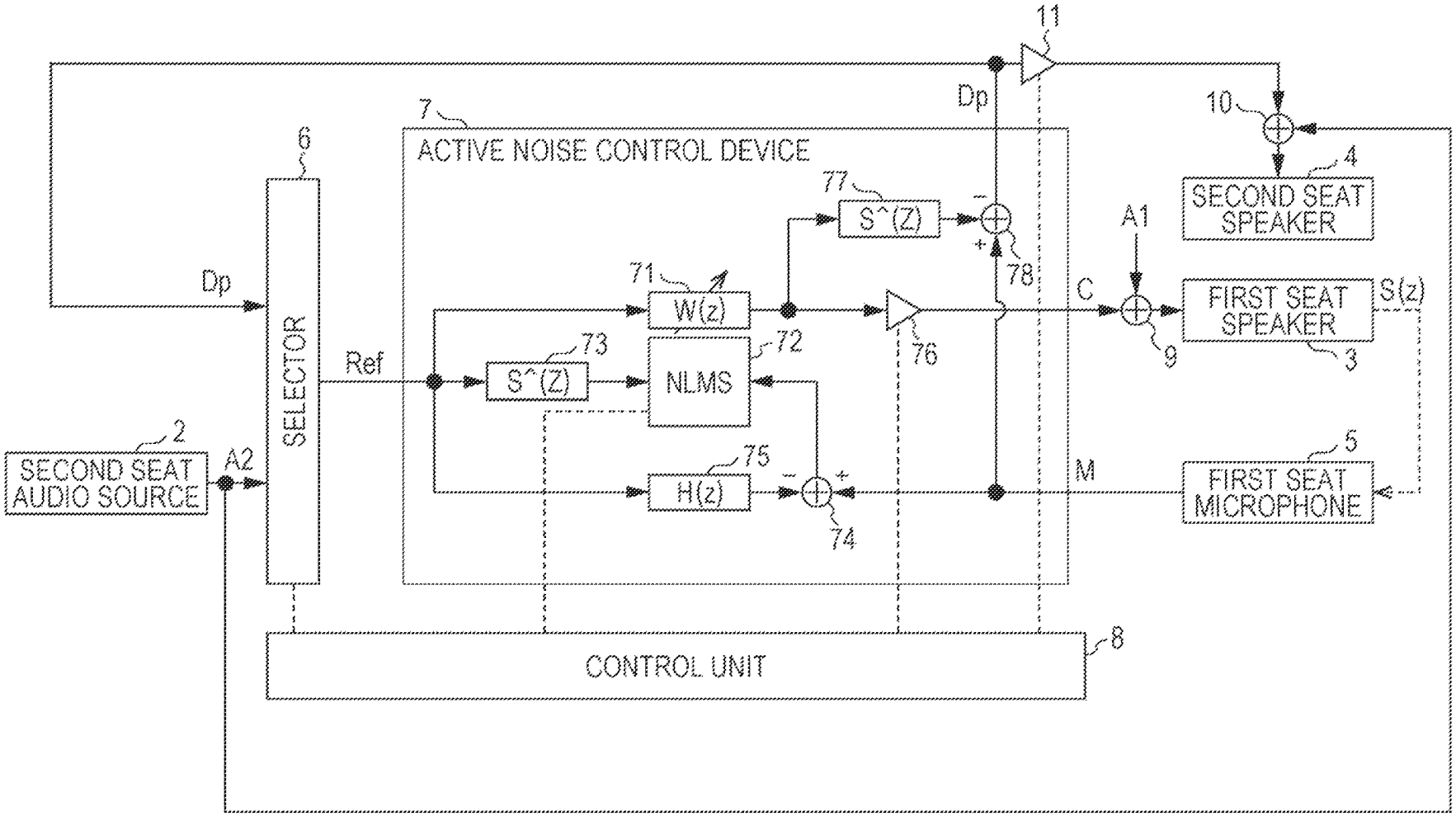
FIG. 3 is a block diagram illustrating a configuration of an active noise control device according to the first embodiment of the disclosure.

Next, FIG. 3 illustrates a configuration of the active noise control device 7. As illustrated in the drawing, the active noise control device 7 includes a first variable filter 71, a first adaptive algorithm execution unit 72, a first estimation filter 73 in which a transfer function Ŝ(z) is set in advance, a first subtractor 74, an auxiliary filter 75 in which a transfer function H(z) is set in advance, a first mute unit 76, a second estimation filter 77 in which the transfer function Ŝ(z) is set in advance, and a second subtractor 78.

Here, the transfer function Ŝ(z) is a transfer characteristic Ŝ obtained by estimating a transfer function S(z) from the active noise control device 7 to the first seat microphone 5 by actual measurement or the like.

The reference sound Ref input from the selector 6 passes through the first variable filter 71 and is output as the cancel sound C from the first seat speaker 3 via the first seat speaker adder 9. Under the control of the control unit 8, the first mute unit 76 silences (mutes) the output of the cancel sound C to the first seat speaker 3.

The output of the first variable filter 71 is also transmitted to the second estimation filter 77, and the second estimation filter 77 convolves the transfer characteristic Ŝ(z) with the output of the first variable filter 71 and outputs the result to the second subtractor 78. The second subtractor 78 subtracts the output of the second estimation filter 77 from the sound M collected by the first seat microphone 5. The output of the second subtractor 78 is transmitted the uttered voice signal Dp to the selector 6, and is output from the second seat speaker 4 via the uttered voice relay unit 11 and the second seat speaker adder 10.

Further, the reference sound Ref input from the selector 6 is sent to the first subtractor 74 through the auxiliary filter 75.

The first subtractor 74 subtracts the output of the auxiliary filter 75 from the sound collected by the first seat microphone 5, and outputs the subtracted signal to the first adaptive algorithm execution unit 72.

The transfer function H(z) for correcting a signal actually output by the first seat microphone 5 is preset in the auxiliary filter 75 so that the output of the first subtractor 74 becomes a signal output from the first seat microphone 5 when the first seat microphone 5 is located at the position of the ear of the user at the first seat. A method of setting the transfer function H(z) of the auxiliary filter 75 will be described later.

Next, the first estimation filter 73 convolves the transfer characteristic Ŝ(z) with the output of the selector 6 and outputs the result to the first adaptive algorithm execution unit 72.

The first variable filter 71, the first adaptive algorithm execution unit 72, and the estimation filter form a filtered-X adaptive filter.

The first adaptive algorithm execution unit 72 uses the signal output from the first subtractor 74 as an error, executes an adaptive algorithm such as NLMS or LMS using the output of the estimation filter, and performs an adaptive operation of updating a transfer function W(z) of the first variable filter 71 so as to minimize the level of the signal output from the first subtractor 74.

The present in-vehicle communication support system includes, as operation modes, an ICC mode in which the uttered voice of the user at the first seat collected by the first seat microphone 5 is output from the second seat speaker 4, and a non-ICC mode in which the uttered voice of the user at the first seat collected by the first seat microphone 5 is not output from the second seat speaker 4.

In the non-ICC mode, the control unit 8 causes the selector 6 to output the output sound A2 of the second seat audio source 2 to the active noise control device 7 as the reference sound Ref, and causes the uttered voice relay unit 11 to mute the output of the uttered voice signal Dp to the second seat speaker 4.

Therefore, in the non-ICC mode, the transfer function W(z) of the first variable filter 71 is updated by the adaptive operation of the first adaptive algorithm execution unit 72 such that the component of the output sound A2 of the second seat audio source 2 included in the output of the first subtractor 74 is minimized. As a result, the first variable filter 71 is adapted to output the cancel sound C that cancels the sound output from the second seat audio source 2 at the position of the ear of the user at the first seat.

On the other hand, in the ICC mode, the control unit 8 unmutes the output of the uttered voice signal Dp of the uttered voice relay unit 11 to the second seat speaker 4, and causes the selector 6 to output the uttered voice signal Dp to the active noise control device 7 as the reference sound Ref.

Therefore, in the ICC mode, the transfer function W(z) of the first variable filter 71 is updated by the adaptive operation of the first adaptive algorithm execution unit 72 such that the component of the uttered voice signal Dp included in the output of the first subtractor 74 is minimized. Since the uttered voice signal Dp is obtained by removing the component of the cancel sound C included in the output of the first seat microphone 5 from the sound M collected by the first seat microphone 5, when the output of the first seat microphone 5 includes the uttered voice of the user at the first seat, the first variable filter 71 is adapted to output the cancel sound C that cancels the uttered voice component of the user at the first seat output from the second seat speaker 4 at the position of the ear of the user at the first seat. In addition, the output of the cancel sound C also cancels and suppresses the component of the uttered voice of the user at the first seat output from second seat speaker 4, the speech sound component being collected by the first seat microphone 5 near the position of the ear of the user at the first seat. By outputting the uttered voice signal Dp to the second seat speaker 4, the uttered voice of the user in the first seat is output from the second seat speaker 4 to the user in the second seat.

Hereinafter, a mode switching process performed by the control unit 8 at the time of switching between the ICC mode and the non-ICC mode will be described.

Figure 4:
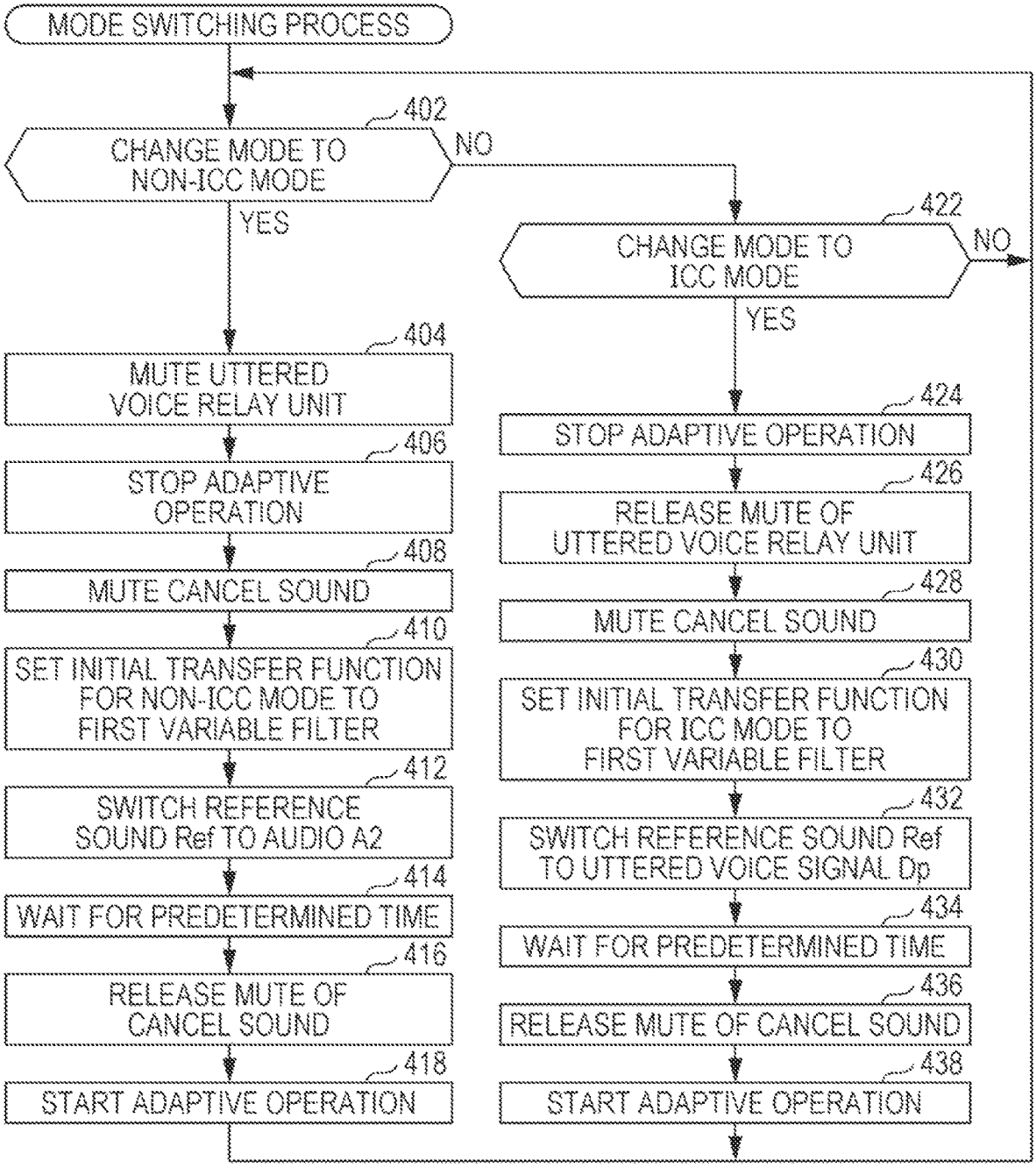
FIG. 4 is a flowchart illustrating a mode switching process according to the first embodiment of the disclosure.

FIG. 4 illustrates a procedure of the mode switching process.

As shown in the drawing, when the operation mode is switched from the ICC mode to the non-ICC mode (Step 402), the control unit 8 first causes the uttered voice relay unit 11 to mute the output of the uttered voice signal Dp to the second seat speaker 4 (Step 404).

Then, the adaptive operation of the active noise control device 7 is stopped by stopping the update of the transfer function W(z) of the first variable filter 71 (Step 406). More specifically, the update of the transfer function W(z) of the first variable filter 71 is stopped by setting the step size for determining the gain for the update of the transfer function W(z) performed by the first adaptive algorithm execution unit 72 to 0.

In addition, the first mute unit 76 is caused to mute the output of the cancel sound C (Step 408).

Then, an initial transfer function predetermined for the non-ICC mode is set as the transfer function W(z) in the first variable filter 71 (Step 410).

Next, the reference sound Ref output by the selector 6 is switched to the output sound A2 of the second audio source (Step 412), and a predetermined time is waited (Step 414). The predetermined time is a time corresponding to a delay by each filter of the active noise control device 7.

Then, the mute of the output of the cancel sound C of the first mute unit 76 is released (Step 416), and the adaptive operation of the active noise control device 7 is started (Step 418). More specifically, in Step 418, the step size for determining the gain for updating the transfer function W(z) performed by the first adaptive algorithm execution unit 72 is returned to the original value before the adaptive operation is stopped in Step 406.

On the other hand, when the operation mode is switched from the non-ICC mode to the ICC mode (Step 422), the control unit 8 stops the adaptive operation of the active noise control device 7 by stopping the update of the transfer function W(z) of the first variable filter 71 (Step 424), and releases the mute of the output of the uttered voice signal Dp of the uttered voice relay unit 11 to the second seat speaker 4 (Step 426).

Then, the first mute unit 76 is caused to mute the output of the cancel sound C (Step 428), and an initial transfer function predetermined for the ICC mode is set in the first variable filter 71 as the transfer function W(z) (Step 430).

Next, the reference sound Ref output of the selector 6 is switched to the uttered voice signal Dp (Step 432), and a predetermined time is waited (Step 434). The predetermined time is a time corresponding to a delay by each filter of the active noise control device 7.

The mute of the output of the cancel sound C of the first mute unit 76 is released (Step 436), and the adaptive operation of the active noise control device 7 is started (Step 438).

Implementations of the mode switching process performed by the control unit 8 has been described above.

Next, a method for setting the transfer function H(z) of the auxiliary filter 75 of the active noise control device 7 described above will be described.

The transfer function H(z) for the auxiliary filter 75 is set by, for example, performing a first-stage learning process and a second-stage learning process described below in advance while the sound output from the second seat audio source 2 is being output from the second seat speaker 4.

Figure 5A:
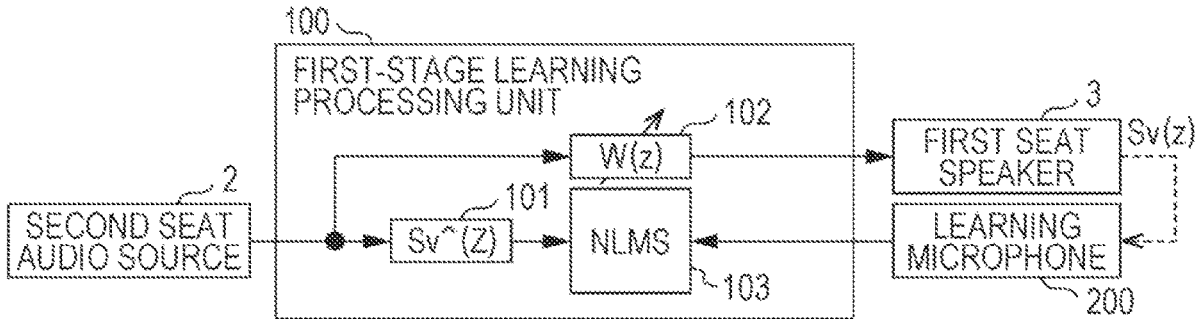
FIGS. 5A and 5B are block diagrams illustrating a configuration of learning of a transfer function of an auxiliary filter according to the first embodiment of the disclosure.

The first-stage learning process is performed using a first-stage learning processing unit 100 illustrated in FIG. 5A and a learning microphone 200 disposed at the position of the ear of the first seat user.

The first-stage learning processing unit 100 includes a learning estimation filter 101 in which an estimation value Sv^z) of a transfer function S^(z) from the first-stage learning processing unit 100 to the learning microphone 200 is set, a first-stage learning variable filter 102, and a first-stage learning adaptive algorithm execution unit 103.

In such a configuration, the sound output from the second seat audio source 2 is input to the first-stage learning variable filter 102, and output from the first-stage learning variable filter 102 is output to the first seat speaker 3. In addition, the first-stage learning adaptive algorithm execution unit 103 executes an adaptive algorithm such as NLMS or LMS using the output of the learning microphone 200 as an error while using the output of the learning estimation filter 101, and updates the transfer function W(z) of the first-stage learning variable filter 102.

Then, the adaptive algorithm is executed to obtain the transfer function W(z) of the converged and stabilized first-stage learning variable filter 102 as a result of the first-stage learning process.

Figure 5B:
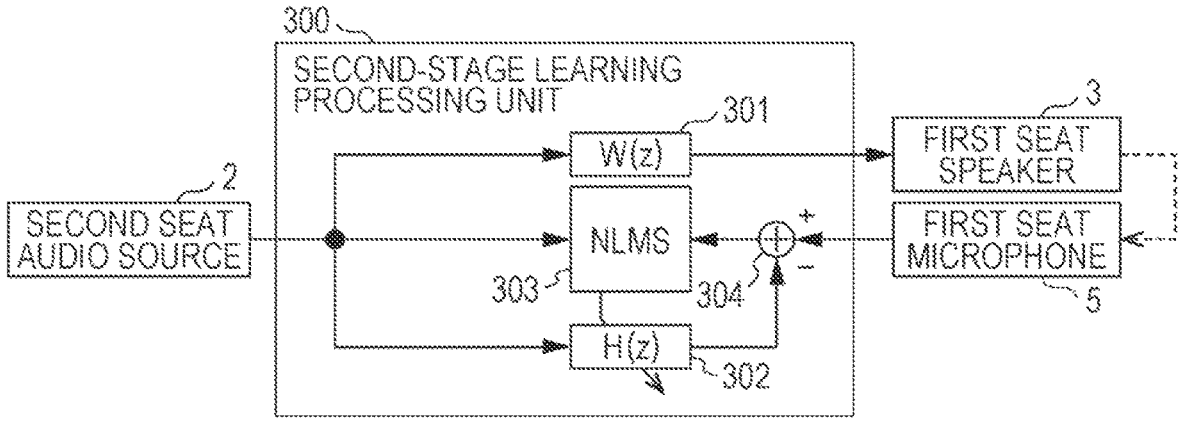

Next, the second-stage learning process is performed using a second-stage learning processing unit 300 illustrated in FIG. 5B.

The second-stage learning processing unit 300 includes a second-stage learning fixed filter 301 in which the transfer function W(z) obtained as a result of the first-stage learning process is set as a transfer function, a second-stage learning variable filter 302, a second-stage learning adaptive algorithm execution unit 303, and a second-stage learning subtractor 304.

In this configuration, the sound output from the second seat audio source 2 is output to the first seat speaker 3 through the second-stage learning fixed filter 301.

The sound output from the second seat audio source 2 is transmitted to the second-stage learning subtractor 304 through the second-stage learning variable filter 302, and the second-stage learning subtractor 304 subtracts the output of the second-stage learning variable filter 302 from the signal picked up by the first seat microphone 5 and outputs the subtracted signal.

The second-stage learning adaptive algorithm execution unit 303 executes an adaptive algorithm such as NLMS or LMS using the sound output from the second seat audio source 2 with the output of the second-stage learning subtractor 304 as an error, and updates the transfer function H(z) of the second-stage learning variable filter 302.

The adaptive algorithm is executed to set the converged and stabilized transfer function H(z) as the transfer function H(z) for the auxiliary filter 75 of the active noise control device 7.

Here, the transfer function H(z) of the auxiliary filter 75 learned in this manner is a transfer function that can be expected that the output of the first subtractor 74 becomes a signal output from the first seat microphone 5 in a case where the first seat microphone 5 is located at the position of the ear of the user at the first seat in the active noise control device 7 as described above.

A first embodiment of the present disclosure has been described as above. Next, a second embodiment of the present disclosure will be described.

Figure 6:
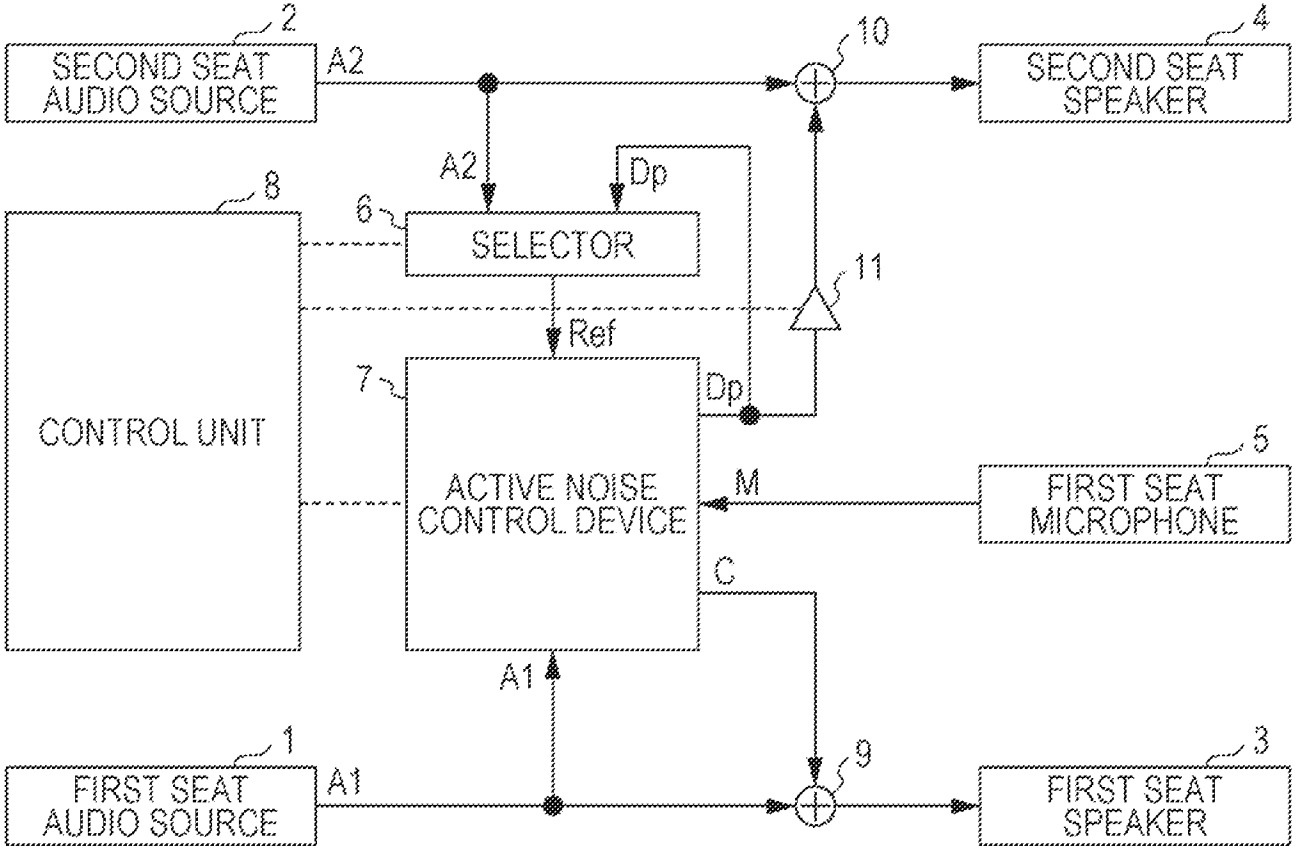
FIG. 6 is a block diagram illustrating a configuration of an in-vehicle communication support system according to a second embodiment of the disclosure.

An in-vehicle communication support system according to the second embodiment is obtained by applying the in-vehicle communication support system according to the first embodiment, and is different from the in-vehicle communication support system according to the first embodiment only in that the output sound A1 of the first audio source is input to the active noise control device 7, the internal configuration of the active noise control device 7, and the content of the mode switching process performed by the control unit 8 as illustrated in FIG. 6.

Figure 7:
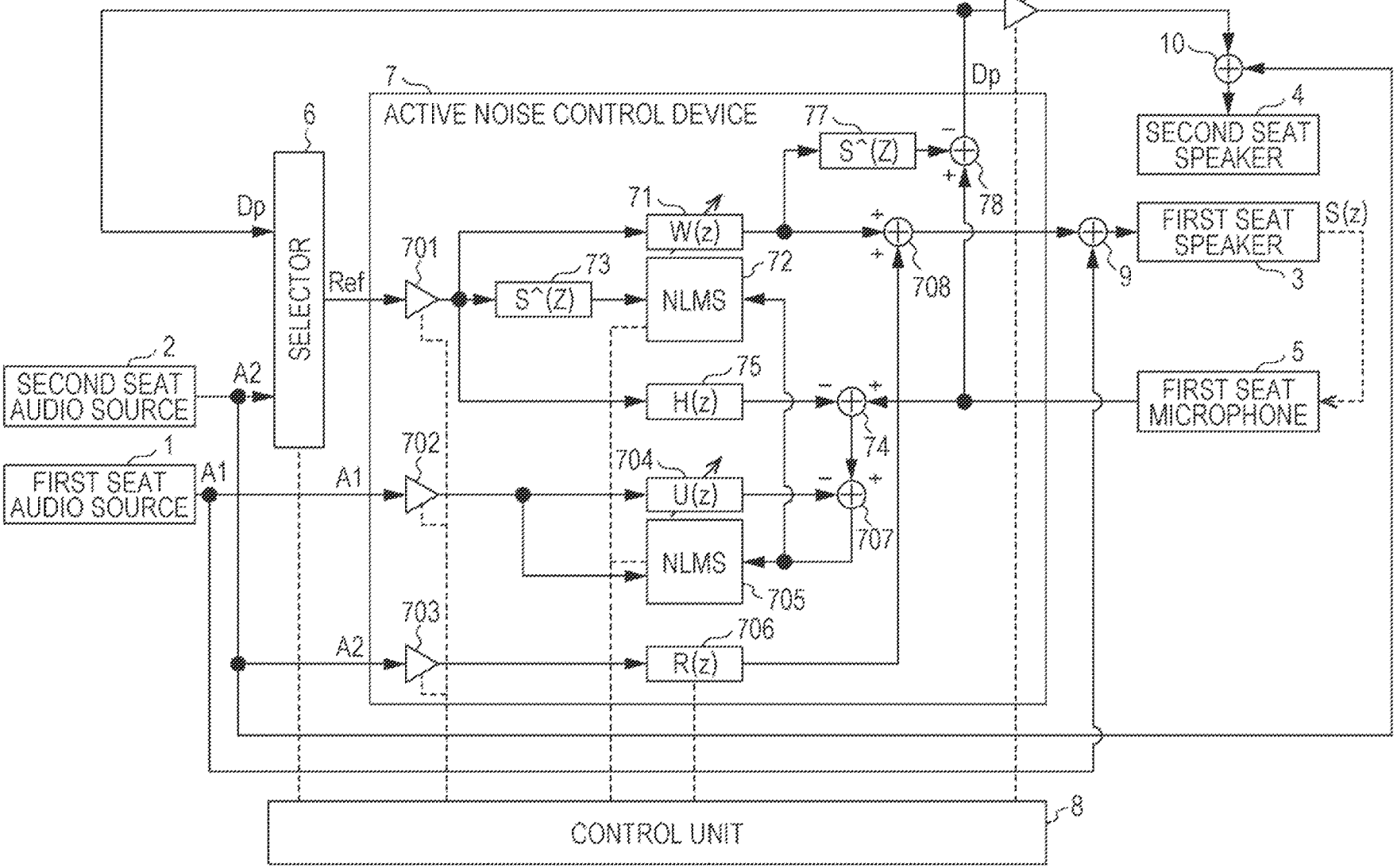
FIG. 7 is a block diagram illustrating a configuration of an active noise control device according to the second embodiment of the disclosure.

FIG. 7 illustrates a configuration of the active noise control device 7 according to the second embodiment.

As shown in the drawing, the active noise control device 7 has a configuration in which a first gain adjustment unit 701, a second gain adjustment unit 702, a third gain adjustment unit 703, a second variable filter 704, a second adaptive algorithm execution unit 705, a fixed filter 706, a third subtractor 707, and a first adder 708 are added to the configuration shown in the first embodiment.

However, in the second embodiment, the output of the first subtractor 74 is sent to the third subtractor 707, and the output of the third subtractor 707 is output to the first adaptive algorithm execution unit 72 instead of the output of the first subtractor 74.

The first gain adjustment unit 701 adjusts the gain of the reference sound Ref input from the selector 6 to the first variable filter 71, the first estimation filter 73, and the auxiliary filter 75.

The second gain adjustment unit 702 adjusts the gain of the output sound A1 from the first seat audio source 1, and outputs the adjusted gain to the second variable filter 704 and the second adaptive algorithm execution unit 705.

The third gain adjustment unit 703 adjusts the gain of the output sound A2 of the second seat audio source 2, and outputs the adjusted gain to the fixed filter 706.

The third subtractor 707 outputs a signal obtained by subtracting the output of the second variable filter 704 from the output of the first subtractor 74 to the first adaptive algorithm execution unit 72 and the second adaptive algorithm execution unit 705.

The first adaptive algorithm execution unit 72 executes an adaptive algorithm with the signal output from the third subtractor 707 as an error, and performs an adaptive operation of updating the transfer function W(z) of the first variable filter 71 so that the level of the signal output from the third subtractor 707 becomes minimum.

The second variable filter 704 and the second adaptive algorithm execution unit 705 also form an adaptive filter, and the second adaptive algorithm execution unit 705 executes an adaptive algorithm such as NLMS or LMS using the output sound A1 of the first seat audio source 1 with the signal output from the third subtractor 707 as an error, and performs an adaptive operation of updating a transfer function U(z) of the second variable filter 704 so that the level of the signal output from the third subtractor 707 is minimized. By this adaptive operation, the transfer function U(z) of the second variable filter 704 is updated such that the component of the output sound A1 of the first seat audio source 1 included in the signal output from the third subtractor 707 is minimized.

The output of the fixed filter 706 is added to the output of the first variable filter 71 by the first adder 708, and output as a part of the cancel sound C from the first seat speaker 3 via the first seat speaker adder 9.

In the non-ICC mode, the control unit 8 causes the selector 6 to output the output sound A2 of the second seat audio source 2 to the active noise control device 7 as the reference sound Ref, causes the uttered voice relay unit 11 to mute the output of the uttered voice signal Dp to the second seat speaker 4, and stops the output of the fixed filter 706.

Therefore, in the non-ICC mode, the transfer function W(z) of the first variable filter 71 is updated by the adaptive operation of the first adaptive algorithm execution unit 72 such that the component of the output sound A2 of the second seat audio source 2 included in the output of the third subtractor 707 is minimized. As a result, the first variable filter 71 is adapted to output the cancel sound C that cancels the sound output from the second seat audio source 2 at the position of the ear of the user at the first seat.

Here, the adaptive operation of the first adaptive algorithm execution unit 72 is performed by the second variable filter 704, the second adaptive algorithm execution unit 705, and the third subtractor 707 using, as an error, a signal obtained by minimizing the component of the output sound A1 of the first seat audio source 1 being output from the first subtractor 74.

Therefore, it can be expected that the first variable filter 71 can more appropriately generate the cancel sound C that cancels the sound output from the second seat audio source 2 at the position of the ear of the user at the first seat.

On the other hand, in the ICC mode, the control unit 8 operates the fixed filter 706 in a state where the transfer function W(z) of the first variable filter 71 in the non-ICC mode immediately before switching to the ICC mode is set as a transfer function R(z) in the fixed filter 706, releases the mute of the output of the uttered voice signal Dp of the uttered voice relay unit 11 to the second seat speaker 4, and causes the selector 6 to output the uttered voice signal Dp as the reference sound Ref to the active noise control device 7.

Therefore, in the ICC mode, the transfer function W(z) of the first variable filter 71 is updated by the adaptive operation of the first adaptive algorithm execution unit 72 such that the component of the uttered voice signal Dp included in the output of the first subtractor 74 is minimized, and the first variable filter 71 is adapted to output the cancel sound C for canceling the uttered voice component of the user at the first seat output from the second seat speaker 4 at the position of the ear of the user at the first seat.

Here, in the adaptive operation of the first adaptive algorithm execution unit 72, the second variable filter 704, the second adaptive algorithm execution unit 705, and the third subtractor 707 perform, as an error, a signal obtained by minimizing the component of the output sound A1 of the first seat audio source 1, which is being output from the first subtractor 74. Therefore, it can be expected that the first variable filter 71 can generate the cancel sound C that cancels, at the position of the ear of the user at the first seat, the uttered voice of the user at the first seat output from the second seat speaker 4 more appropriately.

The uttered voice component of the user at the first seat output from the second seat speaker 4 collected by the first seat microphone 5 near the position of the ear of the user at the first seat is also canceled and suppressed by the output of the cancel sound C. By outputting the uttered voice signal Dp to the second seat speaker 4, the uttered voice of the user in the first seat is output from the second seat speaker 4 to the user in the second seat.

Further, since the output of the fixed filter 706 in which the transfer function W(z) of the first variable filter 71 in the non-ICC mode is set as the transfer function R(z) is output as a part of the cancel sound C, the sound output from the second seat audio source 2 can also be canceled at the position of the ear of the user at the first seat.

Hereinafter, in the second embodiment, a mode switching process performed by the control unit 8 at the time of switching between the ICC mode and the non-ICC mode will be described.

Figure 8:
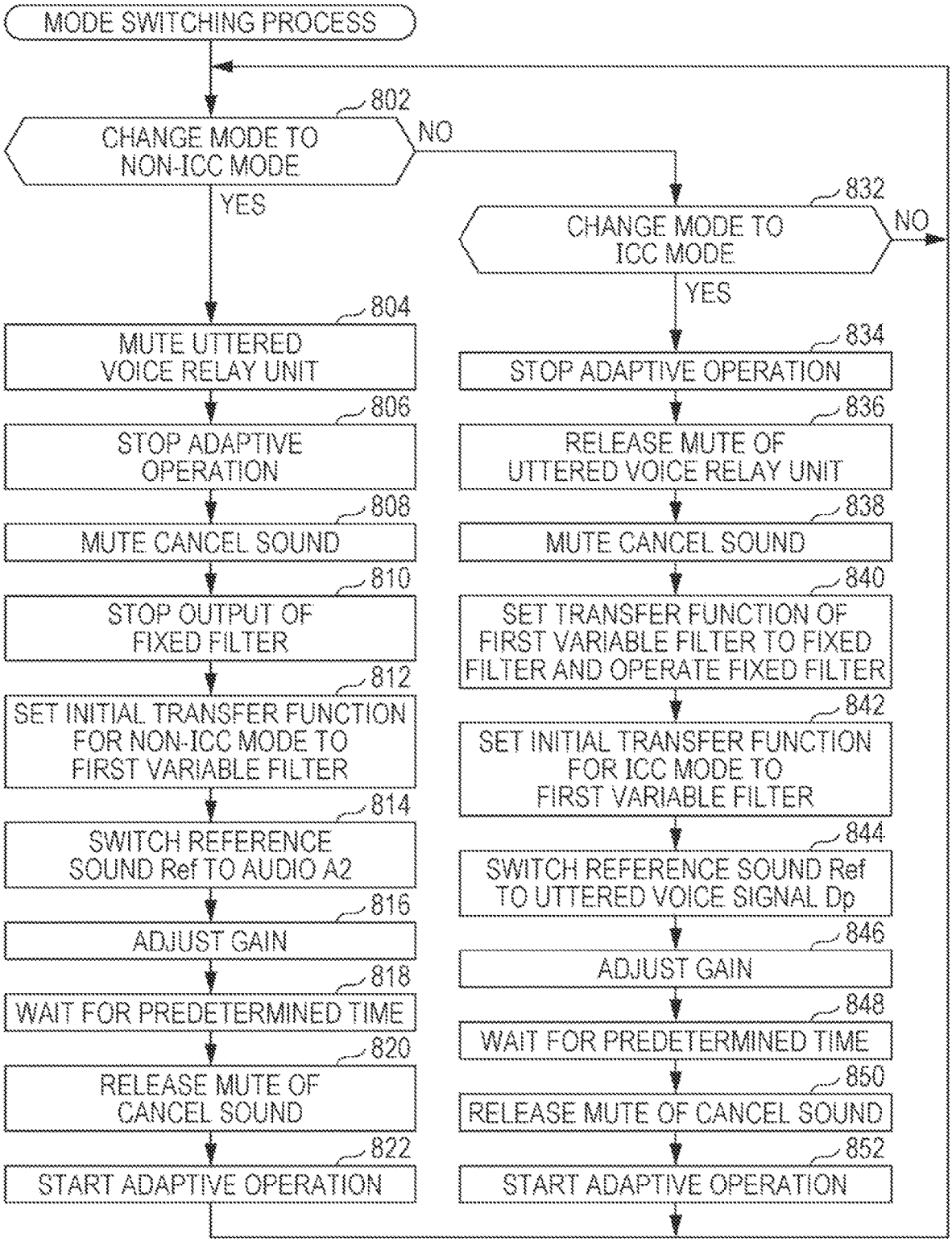
FIG. 8 is a flowchart illustrating a mode switching process according to the second embodiment of the disclosure.

FIG. 8 illustrates a procedure of the mode switching process.

As shown in the drawing, when the operation mode is switched from the ICC mode to the non-ICC mode (Step 802), the control unit 8 causes the uttered voice relay unit 11 to mute the output of the uttered voice signal Dp to the second seat speaker 4 (Step 804), stops the update of the transfer function W(z) of the first variable filter 71 to stop the adaptive operation of the active noise control device 7 (Step 806), and causes the first mute unit 76 to mute the output of the cancel sound C (Step 808).

Then, the output of the fixed filter 706 is stopped (Step 810), and an initial transfer function predetermined for the non-ICC mode is set in the first variable filter 71 as the transfer function W(z) (Step 812).

Next, the reference sound Ref output by the selector 6 is switched to the output sound A2 of the second audio source (Step 814), and the gains of the first gain adjustment unit 701, the second gain adjustment unit 702, and the third gain adjustment unit 703 are adjusted (Step 816).

Then, assuming that the time corresponding to the delay by each filter of the active noise control device 7 is a predetermined time, the process waits for a predetermined time (Step 818), releases the mute of the output of the cancel sound C of the first mute unit 76 (Step 820), and starts the adaptive operation of the active noise control device 7 (Step 822).

On the other hand, when the operation mode is switched from the non-ICC mode to the ICC mode (Step 832), the control unit 8 stops the adaptive operation of the active noise control device 7 by stopping the update of the transfer function W(z) of the first variable filter 71 (Step 834), causes the uttered voice relay unit 11 to release the mute of the output of the uttered voice signal Dp to the second seat speaker 4 (Step 836), and causes the first mute unit 76 to mute the output of the cancel sound C (Step 838).

Then, the transfer function of the first variable filter 71 is acquired and set in the fixed filter 706 as the transfer function of the fixed filter 706, and the fixed filter 706 is operated (Step 840). In addition, an initial transfer function predetermined for the ICC mode is set as the transfer function W(z) in the first variable filter 71 (Step 842).

Next, the reference sound Ref output from the selector 6 is switched to the uttered voice signal Dp (Step 844), and the gains of the first gain adjustment unit 701, the second gain adjustment unit 702, and the third gain adjustment unit 703 are adjusted (Step 846).

Then, assuming that the time corresponding to the delay by each filter of the active noise control device 7 is a predetermined time, the process waits for a predetermined time (Step 848), releases the mute of the output of the cancel sound C of the first mute unit 76 (Step 850), and starts the adaptive operation of the active noise control device 7 (Step 852).

Illustrative embodiments of the disclosure have been described as above. In each of the exemplary embodiments described above, the first seat speaker 3, the second seat speaker 4, and the first seat microphone 5 are provided one by one. However, a plurality of the first seat speakers 3, the second seat speakers 4, and the first seat microphones 5 may be provided.

Further, in each of the above embodiments, the case where the uttered voice of the user at the first seat is output to the second seat speaker 4 while canceling the sound of the second seat audio source 2 to the user at the first seat has been described. However, the present disclosure can be similarly applied to a case where the uttered voice of the user at each seat is output to the speaker at the passenger's seat while canceling the sound of the audio source at the passenger's seat to the user at each seat for a plurality of seats.

Further, each of the above embodiments can be applied to a case where the audio source of each seat has a plurality of channels, or can be extended to cancel the sound of the audio source of the passenger's seat for each of the left and right ears of the user.

In addition, the auxiliary filter 75 of the active noise control device 7 of each of the above embodiments may be omitted, and in this case, a similar effect can be obtained to a predetermined extent.

It is intended that the foregoing detailed description be regarded as illustrative rather than limiting, and that it be understood that it is the following claims, including all equivalents, that are intended to define the spirit and scope of this disclosure.

What is claimed is:

1. An in-vehicle communication support system mounted on an automobile having a first seat and a second seat which are different seats from each other, the in-vehicle communication support system comprising:

a second seat sound source device that is a sound source device of the second seat;

a second seat speaker configured to output an output sound of the second seat sound source device, the second seat speaker being a speaker configured for a user at the second seat;

a microphone configured to collect sound of the first seat;

a noise control unit configured to output a cancel sound and an uttered voice signal;

a first seat speaker configured to output a cancel sound output by the noise control unit, the first seat speaker being a speaker configured for a user at the first seat;

a selector configured to selectively output, to the noise control unit, one of an output sound of the second seat sound source device or the uttered voice signal output from the noise control unit as a reference sound; and a control unit, wherein the noise control unit includes:

an error signal generation unit configured to generate, using an output of the microphone, an error signal including a component of the reference sound being output from the microphone;

a first adaptive filter configured to receive the reference sound as an input and to perform an adaptive operation of updating a transfer function so as to reduce a magnitude of the error signal to generate the cancel sound; and an uttered voice signal generation unit configured to generate, as the uttered voice signal, a signal including a component of a voice uttered by the user at the first seat being output from the microphone, wherein the in-vehicle communication support system has two operation modes: a first operation mode in which the second seat speaker does not output the uttered voice signal output from the noise control unit; and a second operation mode in which the second seat speaker outputs the uttered voice signal output from the noise control unit, and wherein the control unit is configured to cause the selector to output the output sound of the second seat sound source device as the reference sound to the noise control unit in the first operation mode, and to cause the selector to output the uttered voice signal output from the noise control unit as the reference sound to the noise control unit in the second operation mode.

2. The in-vehicle communication support system according to claim 1, wherein the uttered voice signal generation unit is configured to generate, as the uttered voice signal, a signal obtained by removing a component of the cancel sound from the output of the microphone.

3. The in-vehicle communication support system according to claim 2, wherein the uttered voice signal generation unit is configured to generate the uttered voice signal by subtracting a signal obtained by applying a transfer function of a transfer path of the cancel sound to the microphone from the output of the microphone.

4. The in-vehicle communication support system according to claim 3, wherein:

the noise control unit includes an auxiliary filter that is configured to receive the reference sound as an input, the error signal generation unit is configured to generate, as the error signal, a signal obtained by subtracting at least an output of the auxiliary filter from the output of the microphone, and a transfer function obtained in advance as a transfer function for correcting a sound collected by the microphone to a sound collected at a listening position of the sound of the user at the first seat by subtracting an output of the auxiliary filter from the output of the microphone is set in the auxiliary filter.

5. The in-vehicle communication support system according to claim 4, further comprising:

a first seat sound source device configured to output an output sound from the first seat speaker, the first seat sound source device being a sound source device for the first seat, wherein the noise control unit previously generates, as the error signal, a signal obtained by subtracting at least the first seat sound source cancel sound from the output of the microphone.

6. The in-vehicle communication support system according to claim 5, wherein the noise control unit includes:

a fixed filter configured to receive an output sound of the second seat sound source device as an input and to output a second seat sound source cancel sound; and an adder configured to add the second seat sound source cancel sound to the cancel sound and to output the cancel sound from the first seat speaker, and the control unit is configured to cause the adder not to add the second seat sound source cancel sound to the cancel sound in the first operation mode, and to cause the adder to add the second seat sound source cancel sound to the cancel sound in the second operation mode.

7. The in-vehicle communication support system according to claim 6, wherein, when the operation mode is switched from the first operation mode to the second operation mode, the control unit is configured to set a transfer function of the first adaptive filter before the switching as a transfer function of the fixed filter in the fixed filter.

* * * * *